US010421174B2

(12) United States Patent
Wu et al.

(10) Patent No.: US 10,421,174 B2
(45) Date of Patent: Sep. 24, 2019

(54) PNEUMATIC ROTARY TOOL WITH AIR-SUPPLY CONTROL ASSEMBLY

(71) Applicant: DE POAN PNEUMATIC CORP., New Taipei (TW)

(72) Inventors: I-Tsung Wu, Taipei Hsien (TW); Yi-Wei Wen, Taipei Hsien (TW); Meng-Jen Chiu, Taipei Hsien (TW)

(73) Assignee: DE POAN PNEUMATIC CORP., New Taipei (TW)

( * ) Notice: Subject to any disclaimer, the term of this patent is extended or adjusted under 35 U.S.C. 154(b) by 594 days.

(21) Appl. No.: 14/527,837

(22) Filed: Oct. 30, 2014

(65) Prior Publication Data

US 2016/0075008 A1 Mar. 17, 2016

(30) Foreign Application Priority Data

Sep. 16, 2014 (TW) ..... 103131866 A

(51) Int. Cl.
*B25B 21/00* (2006.01)
*B25B 21/02* (2006.01)
*B25F 5/00* (2006.01)

(52) U.S. Cl.
CPC ..... *B25B 21/00* (2013.01); *B25B 21/02* (2013.01); *B25F 5/00* (2013.01)

(58) Field of Classification Search
CPC .... B23B 45/04; B23Q 2005/005; B25F 5/001
USPC ..... 173/221, 169
See application file for complete search history.

(56) References Cited

U.S. PATENT DOCUMENTS 5,303,781 A * 4/1994 Lin ..... B25F 5/00 173/169
5,918,686 A * 7/1999 Izumisawa ..... B25B 21/00 173/169
6,634,438 B1 * 10/2003 Pusateri ..... B25F 5/00 173/1
7,140,179 B2 * 11/2006 Bass ..... B25F 5/00 137/625.24

(Continued)

FOREIGN PATENT DOCUMENTS

TW I266679 B 11/2006
TW I314088 B 9/2009

(Continued)

*Primary Examiner* — Thanh Truong
*Assistant Examiner* — Patrick Fry
(74) *Attorney, Agent, or Firm* — Chun-Ming Shih

(57) ABSTRACT

A pneumatic rotary tool includes a housing, a directional changeover mechanism, and a speed regulating mechanism. The housing includes a top body and a handle. The top body is fitted with a pneumatic motor. The handle defines a forward air channel, a reverse air channel, and an air supply passage. The air supply passage is controlled by a valve being operated by a trigger so that the air supply passage communicates with the forward and reverse air channels. The direction changeover mechanism is mounted in the top body along a transverse line and passes through the forward and reverse air channels for changing the rotational direction of the pneumatic motor. The speed regulating mechanism is mounted in the handle for adjusting the flow of compressed air entering the forward air channel. The tool can be operated conveniently to change the rotational direction and the output torque of the pneumatic motor.

7 Claims, 5 Drawing Sheets

(56) References Cited

U.S. PATENT DOCUMENTS

| | | | | |
|---|---|---|---|---|
| 7,431,102 | B2 * | 10/2008 | Hua | B25B 21/00 173/104 |
| 7,461,704 | B2 * | 12/2008 | Chen | B25F 5/00 173/169 |
| 7,537,027 | B2 * | 5/2009 | Bass | F16K 11/105 137/625.27 |
| 7,594,549 | B2 * | 9/2009 | Hua | B25B 21/00 173/104 |
| 7,802,633 | B2 * | 9/2010 | Kobayashi | B25B 21/00 137/625.43 |
| 9,127,777 | B2 * | 9/2015 | Schamann | F16K 11/07 |
| 2008/0264662 | A1 * | 10/2008 | Chang | B25F 5/00 173/177 |
| 2012/0325510 | A1 * | 12/2012 | Sun | B25B 21/02 173/91 |
| 2012/0325511 | A1 * | 12/2012 | Cheng | B25B 21/00 173/169 |
| 2014/0020923 | A1 * | 1/2014 | Su | B25B 21/00 173/218 |
| 2014/0231111 | A1 * | 8/2014 | Lehnert | B23Q 5/06 173/1 |

FOREIGN PATENT DOCUMENTS

| | | |
|---|---|---|
| TW | I319346 B | 1/2010 |
| TW | I396607 B | 5/2013 |

* cited by examiner

PNEUMATIC ROTARY TOOL WITH AIR-SUPPLY CONTROL ASSEMBLY

(a) TECHNICAL FIELD OF THE INVENTION

The present invention relates to a pneumatic rotary tool with air-supply control assembly and, more particularly, to a pneumatic rotary tool that includes a direction changeover mechanism and a speed regulating mechanism.

(b) DESCRIPTION OF THE PRIOR ART

Typically, pneumatic rotary tools use compressed air to force a pneumatic motor and its drive shaft to rotate. The drive shaft can be installed with a socket to conduct a fastening or drilling operation. During the operation of fastening bolts and nuts, the rotational direction of the drive shaft can be changed by changing the flow direction of the compressed air within the pneumatic rotary tool, so that the functions of fastening and releasing components can be achieved.

In conventional technology, Taiwan Patent Numbers I266679 and I314088 disclosed pneumatic tools, each of which is provided with a cylinder, corresponding to a forward air channel and a reverse air channel, for changing the rotational direction of the pneumatic motor. The cylinder, which defines an opening, can be rotated to a position that allows the opening to be aligned with the forward air channel or the reverse air channel, so that compressed air can flow through the opening to enter the forward air channel to force the pneumatic motor to conduct forward rotation, or compressed air can enter the reverse air channel to force the pneumatic motor to conduct reverse rotation.

Although the above-disclosed pneumatic tools can change the rotational direction of the pneumatic motor, the cylinder is rotated by turning a swing bar, which is often installed at the left side of the pneumatic tool for right-handed persons and thus is inconvenient for left-handed persons.

To solve the inconvenience of changing the rotational direction of the pneumatic motor, there are some pneumatic tools being developed, such as the pneumatic tools disclosed in Taiwan Patent Number I319346 and I396607, wherein a cylinder is provided in the housing of a pneumatic tool and operated by a transverse bar exposed outside the housing. The transverse bar works on the cylinder, by applying force to a part that is far away from the center of the cylinder, for changing the rotational direction of the pneumatic tool.

However, when the user push the transverse bar to rotate the cylinder for changing the rotational direction of the pneumatic motor. Due to the pressure of the compressed air acting on the cylinder is extremely high (about 5~9 $Kg/cm^2$), the lengthy linkage between the transverse bar and the cylinder will be subject to a high resistance and thus result in stress concentration. Thus, it is strenuous and inconvenient for a user to operate the transverse bar for changing the rotational direction of the pneumatic tool.

Furthermore, as disclosed in Taiwan Patent Number I314088, an inner cylinder serving as a torque adjuster is located in the housing of the pneumatic tool, wherein the inner cylinder defines multiple air inlets of different dimensions, through which compressed air can enter the forward air channel. In operation, a user can rotate the inner cylinder to a position to allow the compressed air in the air supply air passage to flow through one of the air inlets to enter the forward air channel Thus, the flow of compressed air entering the forward air channel can be adjusted, and the output torque of the pneumatic motor can be adjusted correspondingly.

However, the air inlets of the torque adjuster used in the above-disclosed pneumatic tool are spaced at an angle of about 120 degrees, which is too large. Thus, a user should rotate the inner cylinder by a long arc distance to change the output torque of the pneumatic tool, and this is inconvenient.

SUMMARY OF THE INVENTION

In view of the foregoing, one object of the present invention is to provide a pneumatic rotary tool that can facilitate a user in changing the rotational direction and the output torque of the pneumatic motor.

To achieve the above object, one technical means of the pneumatic rotary tool comprises a housing and a direction changeover mechanism. The housing includes a top body and a handle extending from the top body. The top body is fitted therein with a pneumatic motor. The handle defines therein a forward air channel, a reverse air channel, and an air supply passage. The forward air channel directs compressed air for allowing the pneumatic motor to conduct forward direction. The reverse air channel directs compressed air for allowing the pneumatic motor to conduct reverse rotation. The air supply passage is controlled by a valve being operated by a trigger so that the air supply passage communicates with the forward air channel and the reverse air channel. The direction changeover mechanism includes a reversing valve disposed in the top body, along a transverse line, between the trigger and the pneumatic motor. The reversing valve passes through the forward air channel and the reverse air channel. The transverse line of the reversing valve is perpendicular to the rotation axis of the pneumatic motor. The reversing valve is operated between a first position, where the forward air channel is introduced with compressed air for allowing the pneumatic motor to conduct forward rotation, and a second state, where the reverse air channel is introduced with compressed air for allowing the pneumatic motor to conduct reverse rotation.

Specifically, the above technical means may further comprise two buttons located at two opposite ends of the reversing valve. Each of the buttons extends out of the top body to facilitate a user in shifting the reversing valve for changing the rotational direction of the pneumatic motor.

Furthermore, in the above technical means, the reversing valve may be formed as a bar-shaped member having two annular protrusions and defining an annular recess between the two annular protrusions. The reversing valve is operated such that, through the annular recess, one of the forward air channel and the reverse air channel is selectively introduced with compressed air so that the pneumatic motor is rotated in a desired direction.

Furthermore, the above technical means may further comprise a speed regulating mechanism rotatably mounted around a shank of the trigger, wherein the air supply passage communicates with the forward air channel through the speed regulating mechanism.

More specifically, the speed regulating mechanism includes a cylinder and a knob. The cylinder is located in the handle and rotatably mounted around the shank of the trigger. The interior of the cylinder communicates with the air supply passage. The cylinder defines one or more air inlets on its wall. The air supply passage is communicable with the forward air channel via one of the air inlets. The knob, being exposed outside the handle, is coupled to the cylinder and rotatably mounted around the shank of the trigger. As such, the cylinder can be rotated by turning the knob to obtain a communicating area between the air inlets and the forward air channel for allowing the pneumatic motor to conduct forward rotation at a desired torque.

Furthermore, the handle defines therein a receiving chamber communicating with the air supply passage, and the cylinder is rotatably mounted in the receiving chamber. As such, the cylinder can be rotated by turning the knob to enable one of the air inlets to overlap an end opening of the forward air channel to obtain the communicating area for allowing the pneumatic motor to conduct forward rotation at a desired torque.

Furthermore, the air inlets include a large air inlet and a small air inlet defined on the cylinder's wall at an angle of more than 30 degrees but less than 90 degrees therebetween. As such, the cylinder can be rotated by turning the knob to enable one of the large air inlet and the small air inlet to overlap the end opening of the forward air channel so as to obtain the communicating area for allowing the pneumatic motor to conduct forward rotation at a desired torque.

Accordingly, the above technical means employs two buttons provided at two opposite ends of the reversing valve and aligned with the transverse line of the reversing valve, so that a user can push either button to shift the reversing valve directly, so that the reversing valve and its linking components can be prevented from damages due to high resistance as commonly seen in conventional technology, so that the service life of the reversing valve can be increased. Furthermore, the above technical means employs a cylinder defining air inlets on its wall, which can overlap the end opening of the forward air channel to obtain a communicating area for adjusting the output torque of the pneumatic motor. Furthermore, the cylinder can be rotated in a shorter arc length compared with conventional technology, thereby facilitating the user in adjusting the output torque.

Another technical means of the present invention comprises a housing, a direction change over mechanism, and a speed regulating mechanism. The housing includes a top body and a handle extending from the top body. The top body is fitted therein with a pneumatic motor. The handle defines therein a forward air channel, a reverse air channel, and an air supply passage. The forward air channel directs compressed air for allowing the pneumatic motor to conduct forward rotation. The reverse air channel directs compressed air for allowing the pneumatic motor to conduct reverse rotation. The air supply passage is controlled by a valve being operated by a trigger so that the air supply passage communicates with the forward air channel and the reverse air channel. The direction changeover mechanism is mounted in the top body for allowing the forward air channel to be introduced with compressed air to have the pneumatic motor conduct forward rotation or allowing the reverse air channel to be introduced with compressed air to have the pneumatic motor conduct reverse rotation. The speed regulating mechanism includes a cylinder and a knob. The cylinder is located in the handle and rotatably mounted around a shank of the trigger. The cylinder defines one or more air inlets on its wall. The air supply passage is communicable with the forward air channel via one of the air inlets of the cylinder. The knob, being exposed outside of the handle, is coupled to the cylinder and rotatably mounted around the shank of the trigger. As such, the cylinder can be rotated by turning the knob to obtain a communicating area between the air inlets and the forward air channel.

Specifically, the handle defines therein a receiving chamber communicating with the air supply passage, and the cylinder is rotatably mounted in the receiving chamber. As such, the cylinder can be rotated by turning the knob to enable one of the air inlets to overlap an end opening of the forward air channel to obtain the communicating area for allowing the pneumatic motor to conduct forward rotation at a desired torque.

Furthermore, the air inlets includes a large air inlet and a small air inlet defined on the cylinder's wall at an angle of more than 30 degrees but less than 90 degrees therebetween. As such, the cylinder can be rotated by turning the knob to enable one of the large air inlet and the small air inlet to overlap the end opening of the forward air channel so as to obtain the communicating area for allowing the pneumatic motor to conduct forward rotation at a desired torque.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
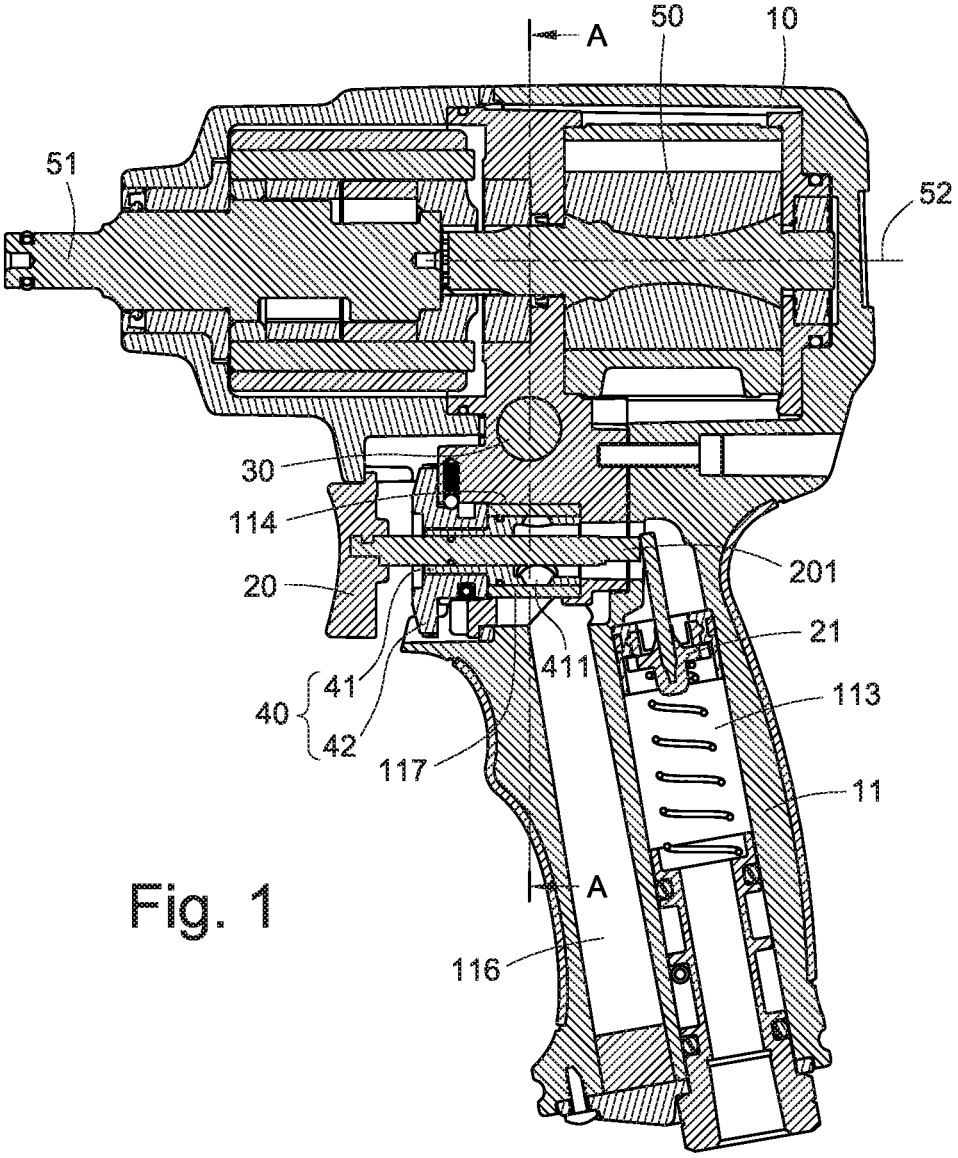
FIG. 1 shows a sectional view of a pneumatic rotary tool according to one embodiment of the present invention.
Figure 2:
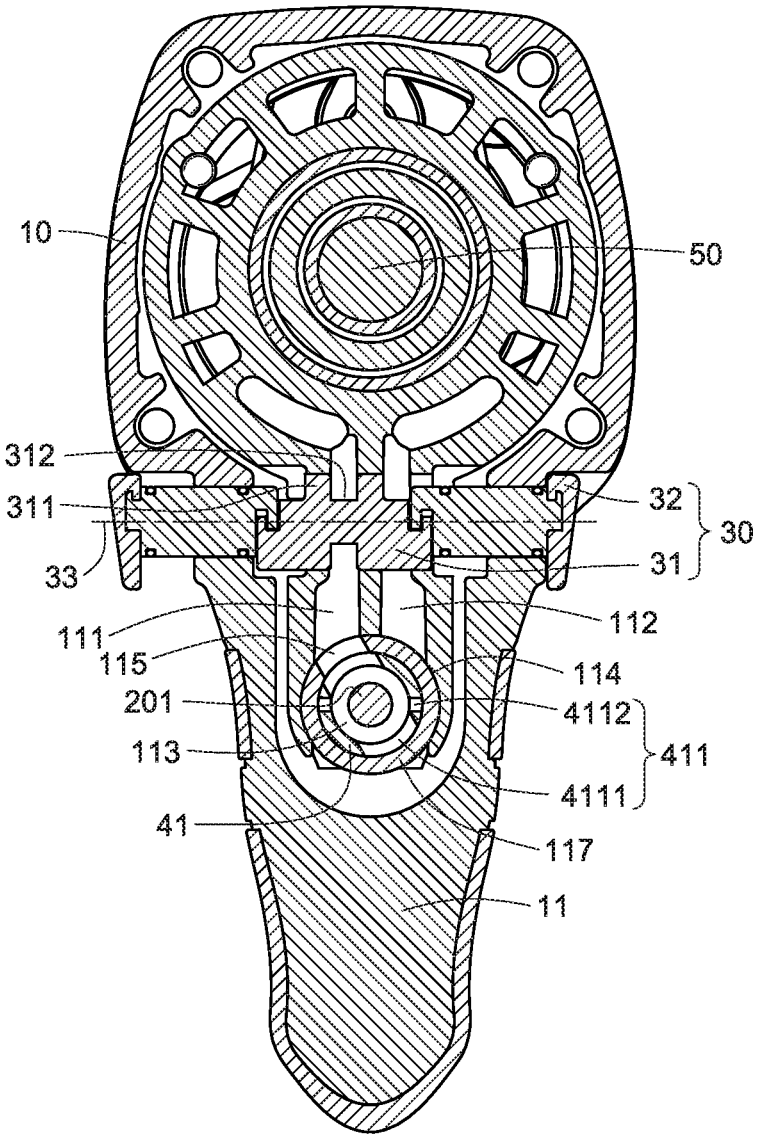
FIG. 2 shows an enlarged sectional view of the pneumatic rotary tool of the embodiment of the present invention taken along line A-A in FIG. 1.
Figure 3:
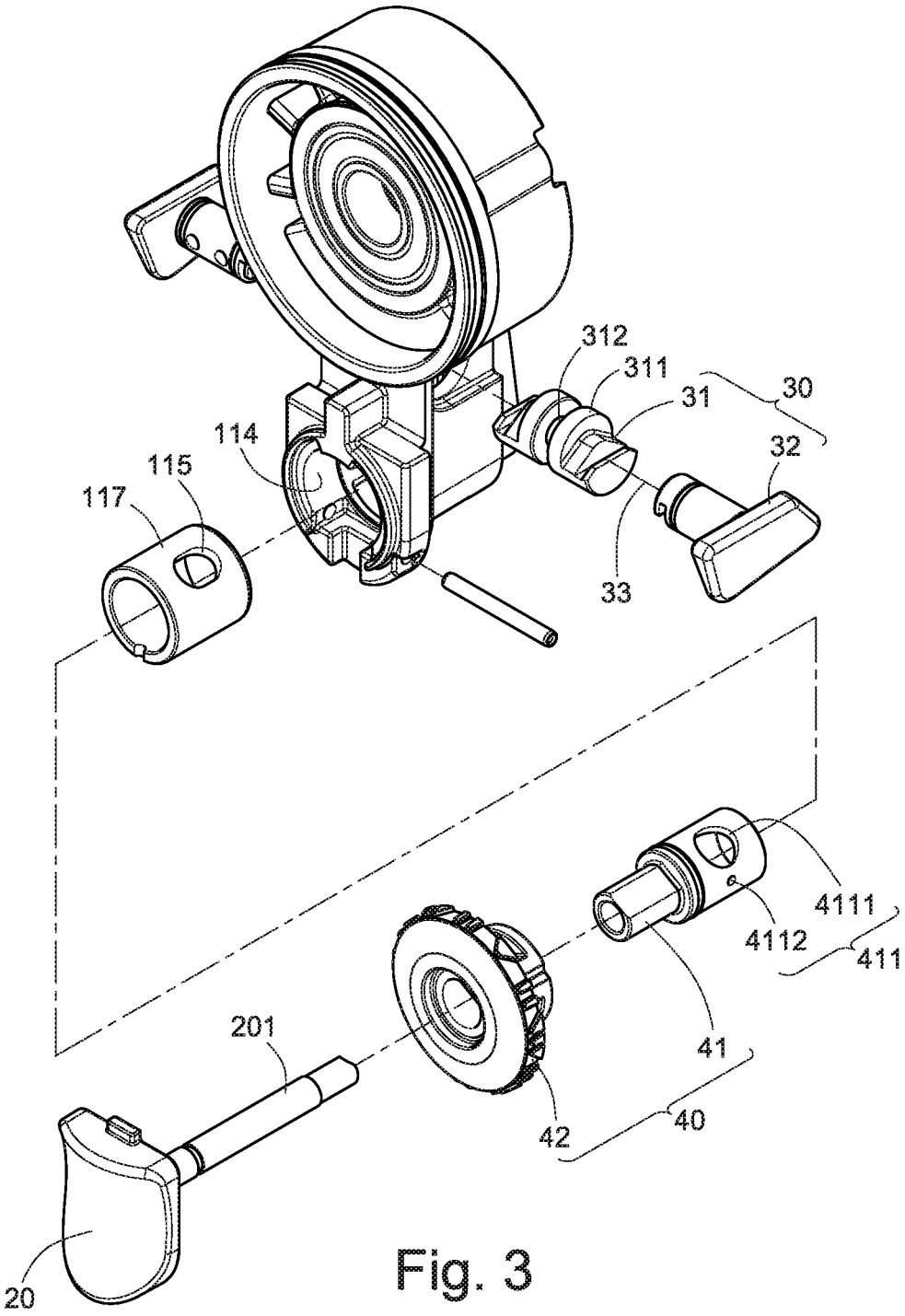
FIG. 3 shows an exploded view of the pneumatic rotary tool of the embodiment of the present invention.

Referring to FIGS. 1 through 3, a pneumatic rotary tool according to a preferred embodiment of the present invention is shown, which generally comprises a housing including a top body 10 and a handle 11, a direction changeover mechanism 30, and a speed regulating mechanism 40.

The handle 11, which extends from the top body 10, defines therein a forward air channel 111, a reverse air channel 112, and an air supply passage 113, wherein the forward air channel 111 and the reverse air channel 112 communicate with the interior of the top body 10; the air supply passage 113 introduces compressed air towards the forward air channel 111 and the reverse air channel 112. The handle 11 is provided with a trigger 20 having a shank 201, which can actuate a valve 21 disposed in the air supply passage 113, so that the trigger 20 can control the compressed air being introduced by the air supply passage 113 to enter the forward air channel 111 and the reverse air channel 112. Thus, a user can depress the trigger 20 to actuate the valve 21 for allowing the compressed air in the air supply passage 113 to enter the forward air supply channel 111 and the reverse air supply channel 12. Furthermore, the handle 11 defines therein an air release passage 116, which allows compressed air to release to the ambient after entering the interior of the top body 10 via the forward air channel 111 or the reverse air channel 112.

The top body 10 is fitted therein with a pneumatic motor 50 that is provided with a drive shaft 51. The pneumatic motor 50 can receive compressed air via the forward air channel 111 or the reverse air channel 112 to rotate the drive shaft 51. For example, when the forward air channel 111 is selected to communicate with the interior of the top body 10 through the direction changeover mechanism 30, compressed air can enter the interior of the top body 10 via the forward air channel 111 to have the pneumatic motor 50 conduct forward rotation, so that the drive shaft 51 can rotate in a forward direction. On the other hand, when the reverse air channel 112 is selected to communicate with the interior of the top body 10 through the direction changeover mechanism 30, compressed air can enter the interior of the top body 10 via the reverse air channel 112 to have the pneumatic motor 50 conduct reverse rotation, so that the drive shaft 51 can rotate in a reverse direction.

Specifically, the direction changeover mechanism 30 includes a reversing valve 31, which is disposed in the top body 10, along a transverse line 33, between the trigger 20 and the pneumatic motor 50, and passes through the forward air channel 111 and the reverse air channel 112. The transverse line 33 of the changeover mechanism 30 is perpendicular to the rotational axis 52 of the pneumatic motor 50 (i.e., the rotational axis of the drive shaft 51). The reversing valve 31 controls the path that compressed air will follow, either via the forward air channel 111 or the reverse air channel 112, for entering the interior of the top body 10. More specifically, the inversing valve 31 is formed as a bar-shaped member having two annular protrusions 311 and defining an annular recess 312 between the two annular protrusions 311. The annular recess 312 allows the compressed air in the air supply passage 113, either via the forward air channel 111 or the reverse air channel 112, to enter the interior of the top body 10. Furthermore, the reversing valve 31 can be provided at its two opposite ends with two buttons 32, which are aligned with the transverse line 33, for facilitating a user in shifting the reversing valve 31 by fingers. Thus, the user can push the buttons 32 to have the reversing valve 31 operated between a first position, where the forward air channel 111 is selected for allowing compressed air to enter the interior of the top body 10 to have the pneumatic motor 50 conduct forward rotation, and a second position, where the reverse air channel 112 is selected for allowing compressed air to enter the interior of the top body 10 to have the pneumatic motor 50 conduct reverse rotation. More specifically, the reversing valve 31 and the buttons 32 can define engagement slots at the associated ends for allowing the buttons 32 to be fixed to the reversing valve 31.

Figure 4:
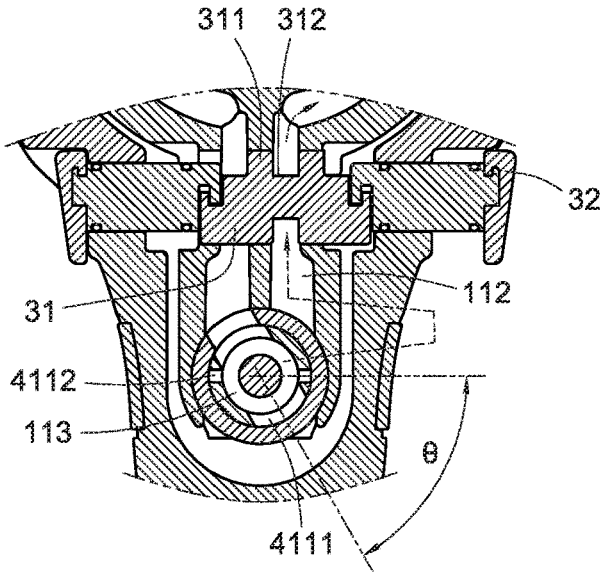
FIG. 4 shows a partially sectional view of the pneumatic rotary tool of the embodiment of the present invention, wherein compressed air may enter the interior of the top body via the reverse air channel by operating the reversing valve.
Figure 5:
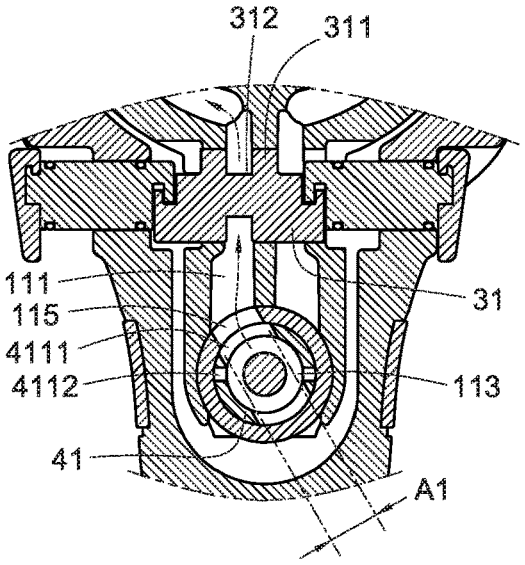
FIGS. 5 through 7 show partially sectional views of the pneumatic rotary tool of the embodiment of the present invention, wherein the flow of compressed air entering the interior of the top body via the forward air channel may be controlled by operating the speed regulating mechanism.

In operating the direction changeover mechanism 30, as shown in FIGS. 4 and 5, a user can push the buttons 32 to shift the reversing valve 31, so that one of the forward air channel 111 and the reverse air channel 112 can be selected to allow compressed air to enter the interior of the top body 10, so that the pneumatic motor 50 can be rotated in a desired direction. For example, when the user push one of the buttons 32 to shift the reversing valve 31 to a position, where the annular recess 312 is aligned with the reverse air channel 112 (see FIG. 4), the compressed air in the reverse air channel 112 can enter the interior of the top body 10 by way of the annular recess 312, so that the pneumatic motor 50 and its drive shaft 51 can conduct reverse rotation. On the other hand, when the user push the other one of the buttons 32 to shift the reversing valve 31 to another position, where the annular recess 312 is aligned with the forward air channel 111 (see FIG. 5), so that the compressed air in the forward air channel 111 can enter the interior of the top body 10 by way of the annular groove 312, so that the pneumatic motor 50 and its drive shaft 51 can conduct forward direction.

Furthermore, the speed regulating mechanism 40 includes a cylinder 41 and a knob 42. The cylinder 41 is located in the handle 11 and rotatably mounted around the shank 201 of the trigger 20. The interior of the cylinder 41 communicates with the air supply passage 113. The cylinder 41 defines a group of air inlets 411 on its wall. The air supply passage 113 can communicate with the forward air channel 111 via the group of air inlets 411. The knob 42, being exposed outside the handle 11, is coupled to the cylinder 41 and rotatably mounted around the shank 201 of the trigger 21, so that the cylinder 41 can be rotated by turning the knob 42 to obtain a communicating area between the group of air inlets 411 and the forward air channel 111. Thus, the compressed air flowing from the air supply passage 113 to the forward air channel 111 can be controlled via the group of air inlets 411 for adjusting the output torque of the pneumatic motor 50.

Specifically, the handle 11 defines therein a receiving chamber 114. The speed regulating mechanism 40 includes a sleeve 117 defining on its wall a through hole 115 communicating with the forward air channel 111. The sleeve 117 is fixedly mounted in the receiving chamber 114 of the handle 11. The air supply passage 113 communicates with the interior of the sleeve 117. The cylinder 41 is rotatably mounted in the sleeve 117 such that the cylinder 41 can be rotated to enable one of the group of air inlets 411 to overlap the through hole 115 of the sleeve 117 to obtain a communicating area for allowing the pneumatic motor 50 to conduct forward rotation at a desired torque. It is noted that the sleeve 117 can be omitted to achieve the purpose of adjusting the output torque of the pneumatic motor 50. In the case of the speed regulating mechanism 40 without the sleeve 117, the receiving chamber 114 communicates with the forward air channel 111, and the cylinder 41 is directly mounted in the receiving chamber 114 that communicates with the air supply passage 113. As such, the cylinder 41 can be rotated to enable one of the air inlets 411 to overlap an end opening of the forward air channel 111 to obtain a communicating area for allowing the pneumatic motor 50 to conduct forward rotation at a desired torque.

Referring to FIGS. 2 and 3, the group of air inlets 411 includes a pair of large air inlets 4111 being opposite with each other and a pair of small air inlets 4112 being opposite with each other. The air supply passage 113 can communicate with the forward air channel 111 by one of the large air inlets 4111 and the small air inlets 4112 overlapping the through hole 115 of the sleeve 117 to obtain the communicating area for adjusting the flow of compressed air entering the forward air channel 111, so as to control the output torque of the pneumatic motor 50. Specifically, as shown in FIG. 4, the pair of the large air inlets 4111 and the pair of the small air inlets 4112 are defined on the wall of the cylinder 41 being spaced at an angle (θ) between the two pairs. In this embodiment, the angle (θ) is about 60 degrees. Nevertheless, in the pneumatic rotary tool of the present invention, the angle (θ) can be a value greater than 30 degrees but small than 90 degrees. More specifically, spring-biasing means, including balls and recesses, can be provided around the cylinder 41 at a constant angle therebetween (not shown) to facilitate a user to adjust the cylinder 41 at the constant angle, wherein the constant angle is equal to the angle (θ), so that one of the large air inlets 4111 and the small air inlets 4112 can overlap the through hole 115 of the sleeve 117, thereby offering the cylinder 41 multi-adjustment capability for controlling the flow of compressed air entering the forward air channel 111 through the cylinder 41 so as to control the output torque of the pneumatic motor 50. Besides, the cylinder 41 can be rotated to a next position in a short arc distance, corresponding to the angle (θ), to adjust the output torque of the pneumatic motor 50, which can facilitate a user in operating the pneumatic rotary tool.

Figure 6:
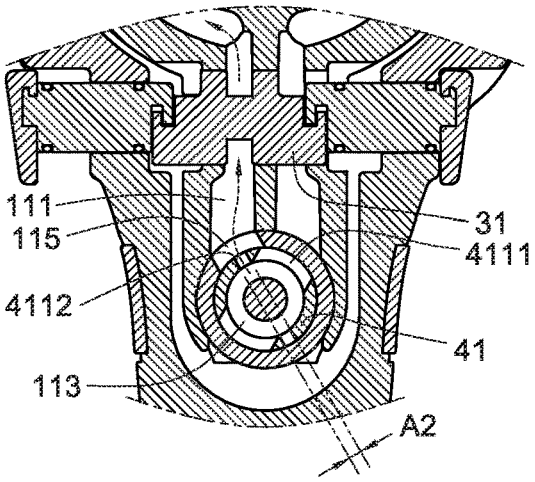
Figure 7:
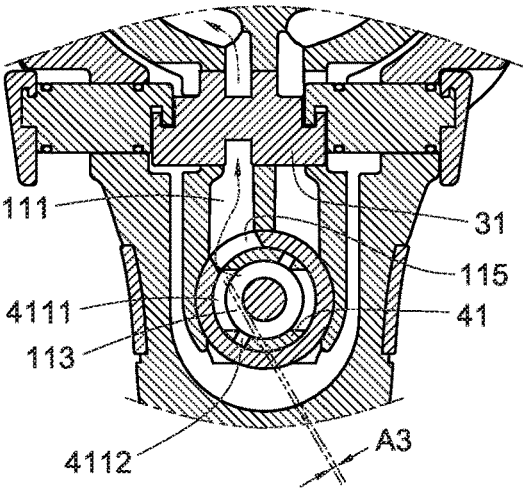

In operating the speed regulating mechanism 40, as shown in FIGS. 5 through 7, a user can rotate the cylinder 41 by turning the knob 42 for adjusting the flow of compressed air entering the forward air channel 111, so that the pneumatic motor 50 can be forced by the compressed air to conduct forward rotation at a high, middle or low output torque. For example, when a high output torque is required, the user can turn the knob 42 to have the cylinder 41 rotated to a position, where one of the large air outlets 4111 overlaps the through hole 115 of the sleeve 117 to obtain the communicating area (A1) (see FIG. 5), so that the compressed air in the air supply passage 113 can go through the communicating area (A1) to enter the forward air channel 111. In this case, the communicating area (A1) is large, and thus the flow of compressed air entering the forward air channel 111 through the cylinder 41 is large, so that the pneumatic motor 50 can produce a high torque for the drive shaft 51. When a middle torque is required, the user can turn the knob 42 to have the cylinder 41 rotated to a position, where one of the small air outlet 4112 overlaps the through hole 115 of the sleeve 117 to obtain the communicating area (A2)(see FIG. 6), so that the compressed air in the air supply passage 113 can go through the communicating area (A2) to enter the forward air channel 111. In this case, the communicating area (A2) is less than the area (A1), and thus the flow of compressed air entering the forward air channel 111 through the cylinder 41 is less than the flow obtained from the area (A1), so that the pneumatic motor 50 can produce a middle torque for the drive shaft 51. When a low torque is required, the user can turn the knob 42 to have the cylinder 41 rotated to a position where the other one of the large air outlets 4111 overlaps (coincides partially with) the through hole 115 of the sleeve 117 to obtain the communicating area (A3)(see FIG. 7), so that the compressed air in the air supply passage 113 can go through the communicating area (A3) to enter the forward air channel 111. In this case, the communicating area (A3) is less than the area (A2), and thus the flow of compressed air entering the forward air channel 111 through the cylinder 41 is smallest compared with the above two cases, so that the pneumatic motor 50 can produce a low torque for the drive shaft 51. Accordingly, in operating the cylinder 41, the user may change the rotational position of the cylinder 41 for every about 60 degrees of rotation, wherein one of the large air inlets 4111 and the small large air inlets 4112 can overlap the through hole 115 of the sleeve 117 to adjust the communicating area therebetween, so as to control the flow of compressed air entering the forward air channel 111 through the cylinder 41, so that the pneumatic motor 50 can conduct forward rotation at a high, middle or low output torque. The cylinder 41 can be rotated to a next predetermined position in a shorter arc distance, compared with conventional technology, to adjust the output torque of the pneumatic motor 50, so that a user can operate the pneumatic rotary tool conveniently.

Alternatively, the speed regulating mechanism 40 of the preferred embodiment of the present invention may be replaced by a conventional speed-regulating mechanism (not shown) for adjusting the output torque of the pneumatic motor 50. For example, the conventional speed-regulating mechanism may be located in the supply air passage 113 of the handle 11 and rotatably mounted around the shank 201 of the trigger 20, so that the air supply air passage 113 can communicate with the forward air channel 111 via the conventional speed-regulating mechanism. Similarly, the conventional speed-regulating mechanism may define a group of air inlets with different dimensions so as to control the flow of compressed air entering the forward air channel 111 to achieve the purpose of adjusting the output torque of the pneumatic motor 50.

Alternatively, the direction changeover mechanism 30 of the preferred embodiment of the present invention may be replaced by a conventional changeover mechanism (not shown) for changing the rotational direction of the drive shaft 51 of the pneumatic motor 50. For example the conventional changeover mechanism may be installed in the handle 10 for controlling the flow of compressed air either entering the forward air channel 111 or the reverse air channel 112, so that a user can operate the conventional changeover mechanism to control the rotational direction of the drive shaft 51 of the pneumatic motor 50.

As a summary, the features of the preferred embodiment of the present invention include the direction changeover mechanism 30 and the speed regulating mechanism 40. The direction changeover mechanism 30 includes the reversing valve 31 and the associated buttons 32, which are aligned along the transverse line of the reversing valve 31. Thus, the user can push the buttons to shift the reversing valve 31 directly to change the rotational direction of the pneumatic motor 50 without causing damages due to highly concentrated stress in the valve or the associated linking components as commonly seen in conventional technology, so that the service life of the reversing valve 31 can be increased. The speed regulating mechanism 40 includes the cylinder 41 and the knob 42. The cylinder 41 defines a pair of large air inlets 4111 and a pair of small air inlets 4112. A user can turn the knob 42 to rotate the cylinder 41 for allowing one of the large air inlets 4111 and the small air inlets 4112 to overlap the through hole 115 of the sleeve 117 to obtain a communicating area therebetween, the output torque of the pneumatic motor 50 can be adjusted. Besides, in adjusting the output torque of the pneumatic motor 50, the cylinder 41 can be rotated in a shorter arc length compared with conventional technology, thereby facilitating the user in operating the pneumatic rotary tool.

Although the present invention has been described with a certain degree of particularity, it is understood that the present disclosure is made by way of example only and the combination and arrangement of parts may be resorted to without departing from the spirit and scope of the invention hereinafter claimed.

We claim:

1. A pneumatic rotary tool, comprising:

a housing including a top body and a handle extending from the top body, the top body being fitted therein with a pneumatic motor, the handle defining therein a forward air channel, a reverse air channel, and an air supply passage, wherein the forward air channel directs compressed air for allowing the pneumatic motor to conduct forward rotation, the reverse air channel directs compressed air for allowing the pneumatic motor to conduct reverse rotation, and the air supply passage is controlled by a valve being operated by a trigger so that the air supply passage communicates with the forward air channel and the reverse air channel; and a direction changeover mechanism including a reversing valve disposed in the top body, along a transverse line, between the trigger and the pneumatic motor, wherein the reversing valve passes through the forward air channel and the reverse air channel, the transverse line of the reversing valve is perpendicular to the rotation axis of the pneumatic motor; and the reversing valve is operated between a first position, where the forward air channel is introduced with compressed air for allowing the pneumatic motor to conduct forward rotation, and a second position, where the reverse air channel is introduced with compressed air for allowing the pneumatic motor to conduct reverse rotation, wherein the reversing valve is formed as a bar-shaped member having two annular protrusions and defining an annular recess between the two annular protrusions, and the reversing valve is operated such that, through the annular recess, one of the forward air channel and the reverse air channel is selectively introduced with compressed air so that the pneumatic motor is rotated in a desired direction.

2. The pneumatic rotary tool of claim 1, wherein the reversing valve is provided at its two opposite ends with two buttons, each of which extends out of the top body to facilitate a user in shifting the reversing valve for changing the rotational direction of the pneumatic motor.

3. The pneumatic rotary tool of claim 1, further comprising a speed regulating mechanism rotatably mounted around a shank of the trigger, wherein the air supply passage communicates with the forward air channel through the speed regulating mechanism.

4. A pneumatic rotary tool, comprising:

a housing including a top body and a handle extending from the top body, the top body being fitted therein with a pneumatic motor, the handle defining therein a forward air channel, a reverse air channel, and an air supply passage, wherein the forward air channel directs compressed air for allowing the pneumatic motor to conduct forward rotation, the reverse air channel directs compressed air for allowing the pneumatic motor to conduct reverse rotation, and the air supply passage is controlled by a valve being operated by a trigger so that the air supply passage communicates with the forward air channel and the reverse air channel;

a direction changeover mechanism including a reversing valve disposed in the top body, along a transverse line, between the trigger and the pneumatic motor, wherein the reversing valve passes through the forward air channel and the reverse air channel, the transverse line of the reversing valve is perpendicular to the rotation axis of the pneumatic motor, and the reversing valve is operated between a first position, where the forward air channel is introduced with compressed air for allowing the pneumatic motor to conduct forward rotation, and a second position, where the reverse air channel is introduced with compressed air for allowing the pneumatic motor to conduct reverse rotation; and a speed regulating mechanism including a cylinder and a knob, wherein the cylinder is located in the handle and rotatably mounted around a shank of the trigger, the cylinder defines one or more air inlets on its wall, the air supply passage is communicable with the forward air channel via one of the air inlets of the cylinder, and the knob, being exposed outside of the handle, is coupled to the cylinder and rotatably mounted around the shank of the trigger, whereby the cylinder is rotated by turning the knob to obtain a communicating area between the air inlets and the forward air channel, wherein the reversing valve is formed as a bar-shaped member having two annular protrusions and defining an annular recess between the two annular protrusions, and the reversing valve is operated such that, through the annular recess, one of the forward air channel and the reverse air channel is selectively introduced with compressed air so that the pneumatic motor is rotated in a desired direction.

5. The pneumatic rotary tool of claim 4, wherein the reversing valve is provided at its two opposite ends with two buttons, each of which extends out of the top body to facilitate a user in shifting the reversing valve for changing the rotational direction of the pneumatic motor.

6. The pneumatic rotary tool of claim 4, wherein the handle defines therein a receiving chamber communicating with the air supply passage, and the cylinder is rotatably mounted in the receiving chamber, whereby the cylinder is rotated by turning the knob to enable one of the air inlets to overlap an end opening of the forward air channel to obtain the communicating area for allowing the pneumatic motor to conduct forward rotation at a desired torque.

7. The pneumatic rotary tool of claim 6, wherein the air inlets include a large air inlet and a small air inlet defined on the cylinder's wall at an angle of more than 30 degrees but less than 90 degrees therebetween, whereby the cylinder is rotated by turning the knob to enable one of the large air inlet and the small air inlet to overlap the end opening of the forward air channel so as to obtain the communicating area for allowing the pneumatic motor to conduct forward rotation at a desired torque.

* * * * *